US007981480B2

(12) United States Patent
Harris et al.

(10) Patent No.: US 7,981,480 B2
(45) Date of Patent: Jul. 19, 2011

(54) HOT DIP COATING APPARATUS

(75) Inventors: Greg Harris, Cordeaux Heights (AU); Nega Setargew, Figtree (AU); David Willis, Albion (AU)

(73) Assignee: Bluescope Steel Limited, Melborne, Victoria (AU)

( * ) Notice: Subject to any disclaimer, the term of this patent is extended or adjusted under 35 U.S.C. 154(b) by 68 days.

(21) Appl. No.: 10/532,224

(22) PCT Filed: Oct. 8, 2003

(86) PCT No.: PCT/AU03/01319

§ 371 (c)(1),
(2), (4) Date: Mar. 14, 2006

(87) PCT Pub. No.: WO2004/033744

PCT Pub. Date: Apr. 22, 2004

(65) Prior Publication Data

US 2006/0233961 A1 Oct. 19, 2006

(51) Int. Cl.
*B05D 1/18* (2006.01)

(52) U.S. Cl. ..... 427/436; 118/419; 118/423

(58) Field of Classification Search ..... 118/423, 118/419; 427/436, 433; 148/318; 420/59, 420/65; 428/453, 627, 472, 472.2, 698, 685
See application file for complete search history.

(56) References Cited

U.S. PATENT DOCUMENTS

| | | | | |
|---|---|---|---|---|
| 4,609,577 | A * | 9/1986 | Long | 428/683 |
| 5,571,327 | A * | 11/1996 | Ookouchi et al. | 118/423 |
| 5,783,143 | A | 7/1998 | Handa et al. | |
| 6,284,062 | B1 | 9/2001 | Nagashima et al. | |

FOREIGN PATENT DOCUMENTS

| | | |
|---|---|---|
| JP | 07-278754 | 10/1995 |
| JP | 11294478 | 10/1999 |
| JP | 2000054095 | 2/2000 |
| JP | 2001207247 | 7/2001 |

* cited by examiner

*Primary Examiner* — Brenda A Lamb
(74) *Attorney, Agent, or Firm* — Hahn Loeser & Parks, LLP

(57) ABSTRACT

Hot dip coating apparatus for coating a steel strip in an Al—Zn alloy bath comprises components that are made from stainless steel containing an appreciable amount of nitrogen distributed substantially uniformly through its microstructure. The nitrogen is incorporated into the stainless steel as an alloy additive and improves the steel's corrosion resistance and minimizes pitting and thinning of the component when immersed in the metal bath for extended periods.

8 Claims, 4 Drawing Sheets

Prior Art

HOT DIP COATING APPARATUS

CROSS-REFERENCE TO RELATED APPLICATIONS

This application is a U.S. national counterpart application under 35 U.S.C. 371 of international application serial no. PCT/AU2003/001319 filed Oct. 8, 2003, which claims priority to Australian application serial no. 2002951907 filed Oct. 8, 2002.

TECHNICAL FIELD

This invention relates to the continuous, hot dip coating of steel strip with a coating alloy that contains aluminium. More particularly, the invention relates to the in-bath components of apparatus used to effect such a coating process.

BACKGROUND ART

Traditionally steel strip was coated with zinc and was then referred to as galvanised steel. Zinc coatings have long been supplanted by coating of an aluminium-zinc alloy. Such alloy coatings retain the sacrificial protection afforded by zinc enhanced by the corrosion resistance of aluminium. A typical coating alloy may nominally comprise 45% zinc and 55% aluminium.

To effect the hot dip coating process the steel strip is drawn through a pool of the molten coating alloy within an open topped bath. To control the passage of the strip into and then out of the pool of alloy, referred to hereinafter as the bath metal in accordance with conventional terminology, the strip is caused to pass under a sink roll submerged in said bath metal.

Conventionally the sink roll and its submerged supporting structure have been made of a corrosion resistant alloy steel, for example a commercially available steel designated grade 316L stainless steel. Even so the working life of the submerged components is relatively short due to the corrosive effect of the bath metal and the build-up of intermetallic deposits resulting from chemical reaction between the components and the bath metal.

Prior art FIGS. 1 and 2 of the accompanying drawings illustrate the results arising from the use of 316L stainless steel.

FIG. 1 is a schematic diagram of the microstructure 50 of portion of a sink roll of 316L stainless steel 51. It shows a deposit of a mixture of bath metal 52 and intermetallic compound 53 on the surface of a normal alloy layer 54, which includes iron, chromium, nickel and aluminium, and which forms when the sink roll is immersed in the bath metal.

FIG. 1 also show the presence of σ-phase grain boundary precipitates 55. 316L stainless steel 51, and most other stainless steels, are susceptible to the formation of σ-phase precipitates over extended immersion times, which make the steel hard and brittle. Furthermore the σ-phase precipitates are rich in chromium and molybdenum so that their growth causes depletion of those elements in the grains surrounding the σ-phase precipitates. The presence of such micro-cracks together with the depletion of the overall chromium and molybdenum in the grains leads to high dissolution rates of the steel when exposed to the molten bath metal 52. Such dissolution manifests itself as pitting and other erosion of the submerged components.

Because the deleterious effect of depositing of the intermetallic compounds 53 on the quality of the finished product it is necessary to dress the roll from time to time to remove the deposit. This dressing is an expensive process, and it requires the coating operation to be interrupted for the removal and replacement of the sink roll.

Prior art FIG. 2 illustrates a severely pitted sink roll support arm fabricated from 316L stainless steel. Of course a sink roll, because it contacts the strip being coated and the coating quality depends on the smoothness of the roll, would have to be withdrawn from service long before it reached the state of the arm appearing in FIG. 2.

To overcome the deficiencies outlined above it has been proposed to subject the sink roll to a nitriding process. Nitriding is a conventional process affecting a thin surface layer of the component being nitrided and comprises holding the component for long periods in a furnace having an ammonia atmosphere.

When a sink roll that has been subjected to a nitriding process is immersed in the bath metal, the nitrides react with the aluminium in the bath metal, so that in addition to forming the alloy layer, a layer of aluminium nitride forms on its outer surface. This aluminium nitride layer is stable and acts as a protective, adherent surface layer on the component.

Prior art FIG. 3 is a view similar to FIG. 1 in respect of a nitrided 316L stainless steel sink roll. The figure shows all of the features of FIG. 1, but also shows a nitrided layer 56 with an aluminium nitride surface layer between the mixture of bath metal 52 and intermetallic compound 53 and the normal alloy layer 54 that forms when the sink roll is immersed in the bath metal. It will be noted that FIG. 3 also shows the presence of σ-phase precipitates 55 in the microstructure.

Nitriding is beneficial in that the stable aluminium nitride layer renders the intermetallic compounds less adherent to the roll. This facilitates their removal by scraping and prolongs the periods between dressings of the sink roll. The aluminium nitride layer also acts as a protecting layer and limits pitting or erosion of the component. The disadvantage of the nitriding process is the expense, the expert ability required to perform it, and the long wait required for obtaining the finished component.

SUMMARY OF THE INVENTION

According to a first aspect, the present invention relates to a hot dip coating apparatus for coating a steel strip wherein the strip is immersed in a bath of coating alloy containing aluminium, the apparatus including at least one component having a surface that comes into contact with the bath when in use, wherein the component is made from stainless steel containing an appreciable amount of nitrogen distributed substantially uniformly throughout its microstructure.

The stainless steel used in this aspect of this invention differs from the prior art in that the nitrogen is present as an alloy additive in the stainless steel as distinct from being introduced as part of a nitriding process. The inventors have found that such high nitrogen stainless steels exhibit improved corrosion resistance when immersed in the bath metal.

When making components in accordance with the invention they may be used directly in the hot dip coating apparatus without the need for any pre-treatment such as a nitriding process. In addition, as the nitrogen is distributed throughout the stainless steel microstructure it is not relying on the integrity of the outer surface layer of the component and is therefore considered to be more robust than prior art systems.

In one form, the stainless steel contains greater than 0.10 wt % of nitrogen. The inventors have found that concentrations greater than 0.10 wt % nitrogen exhibit the improved properties which are characteristic of the invention. Austenitic stainless steel which contains nitrogen in the above quantities is commercially available, such as that designated by steel merchants as 316LN.

In one form, the entire component can be made from the stainless steel containing the appreciable amount of nitrogen. In another form, the component may be manufactured as a composite structure with the stainless steel containing the nitrogen being used as an outer layer of the component. In this example, the component may include a further inner layer. This further layer may be formed of any suitable material such as conventional stainless steel such as 316L. This latter form of the invention may be used where the component uses the high nitrogen stainless steel as a protective coating. Such an arrangement may be employed where the component is being relined, or to reduce cost by using a less expensive material as an inner core of the component.

In yet a further aspect, the invention relates to a hot dip coating apparatus for coating a steel strip wherein the strip is immersed in a bath of coating alloy containing aluminium, the apparatus including at least one component having a surface that comes into contact with the bath when in use, wherein the component includes at least one layer made from stainless steel containing an appreciable amount of nitrogen distributed uniformly though its microstructure.

In one form, the component further comprises a further layer wherein the stainless steel layer containing the nitrogen is disposed between the outer surface and the further layer.

In one particular embodiment, the component is a sink roll under which the metal strip is passed.

In yet a further aspect, the invention relates to a method of forming a component of a hot dip apparatus for immersing a sheet metal strip in a bath of coating alloy containing aluminium, wherein the component is formed at least in part from a stainless steel containing an appreciable amount of nitrogen, the nitrogen being dissolved into the stainless steel whilst in a molten state so as to be substantially distributed throughout its microstructure.

In yet a further aspect, the invention relates to a method of coating a steel strip wherein the strip is immersed in a bath of coating alloy containing aluminium, the method comprising the step of passing the steel strip over a component immersed in the bath, wherein the component is made from stainless steel containing an appreciable amount of nitrogen distributed substantially uniformly through its microstructure.

BRIEF DESCRIPTION OF THE DRAWINGS

It is convenient to hereinafter describe an embodiment of the present invention with reference to the accompanying drawings. It is to be appreciated that the particularity of the drawings and the related description is to be understood as not superseding the generality of the broad description of the invention.

In the drawings.

DETAILED DESCRIPTION OF A PREFERRED EMBODIMENT

Figure 1:
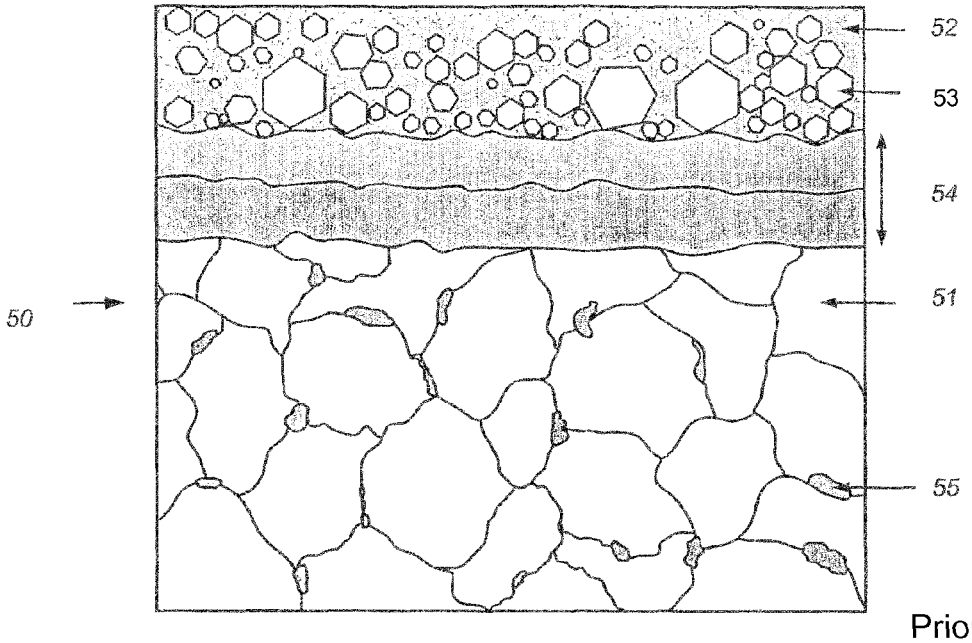
Prior Art FIG. 1
FIG. 1 is a schematic diagram of a microstructure of a sink roll formed from a 316L stainless steel.
Figure 2:
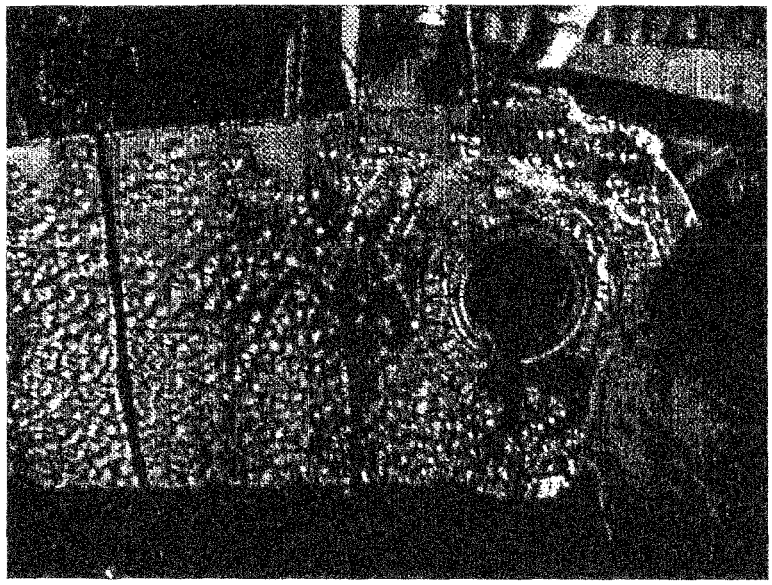
Prior Art FIG. 2
FIG. 2 is a photograph of a severely pitted sink roll support arm fabricated from 316L stainless steel.
Figure 3:
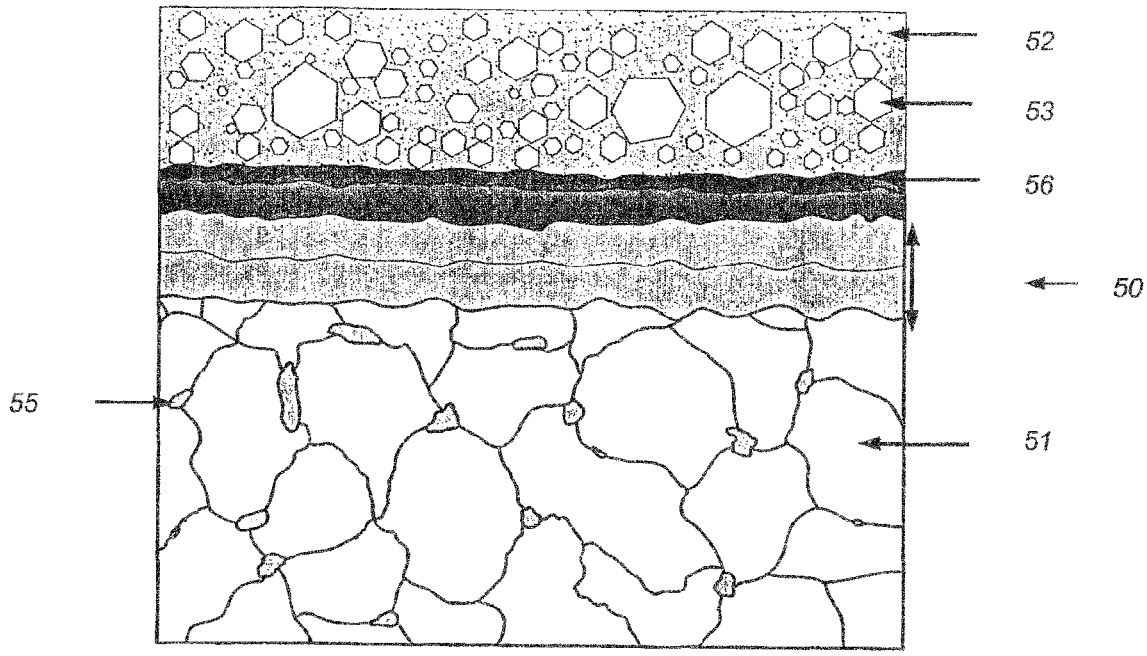
Prior Art FIG. 3
FIG. 3 is a schematic diagram of the microstructure of a sink roll from a nitrided 316L stainless steel.
Figure 4:
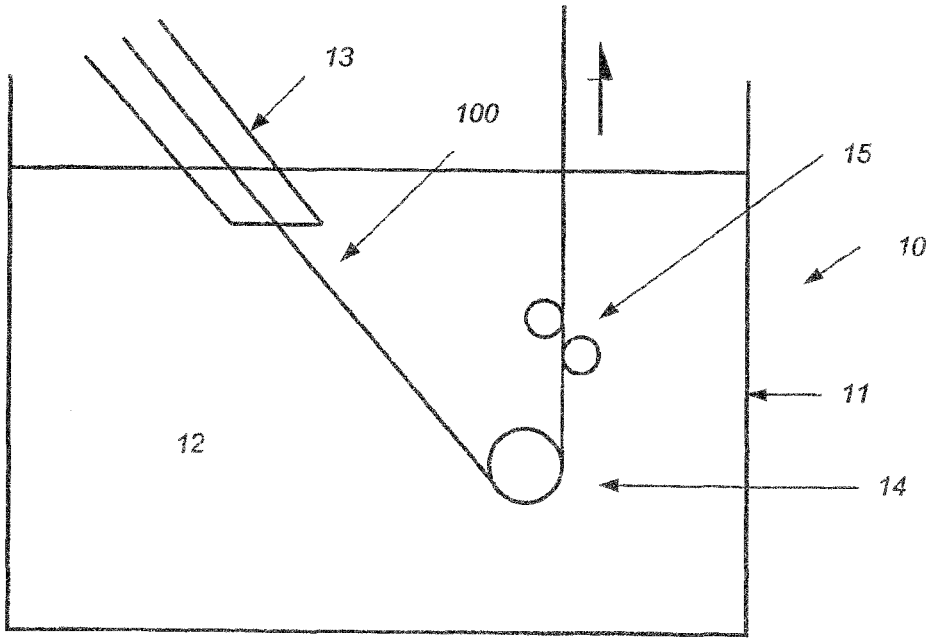
FIG. 4 is a schematic illustration of a hot dip coating apparatus.

FIG. 4 is a schematic illustration of a hot dip coating apparatus 10. The coating apparatus includes a pot 11 which incorporates a pool of molten coating alloy (the bath metal) 12. The pot 11 is open topped and is arranged to receive a steel strip 100 which is drawn through the bath metal 12. To control the passage of the strip 100 into and then out of the bath metal 12, the strip is caused to pass through a snout 13, then under a sink roll 14 submerged in the bath metal, and then through stabilising rolls 15 before leaving the bath metal.

To improve the corrosion resistance of the hot dipped coating apparatus 10, at least some of the in bath components and, in particular, the sink roll 14, is formed from a high nitrogen stainless steel. Other components, such as the stabilising rolls 15, the snout 13 or the support arms and bearings for the sink roll 14 or stabling rolls 15 may also be made from a high nitrogen stainless steel. The nitrogen is incorporated as an alloy additive into the stainless steel whilst in its molten state so that it is distributed substantially uniformly throughout its microstructure.

Figure 5:
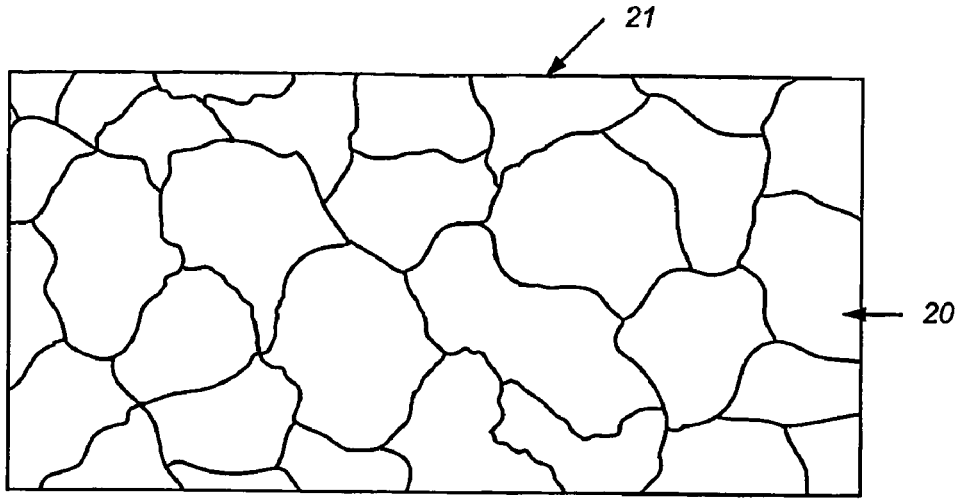
FIG. 5 is a schematic diagram of a microstructure of a sink roll formed from a high nitrogen stainless steel.

FIG. 5 is a schematic diagram of the microstructure 20 of a portion of a component of the apparatus 10, typically the sink roll 14. The component is manufactured from a high nitrogen stainless steel which extends to an outer surface 21 which in use is exposed to the bath metal 12.

Figure 6:
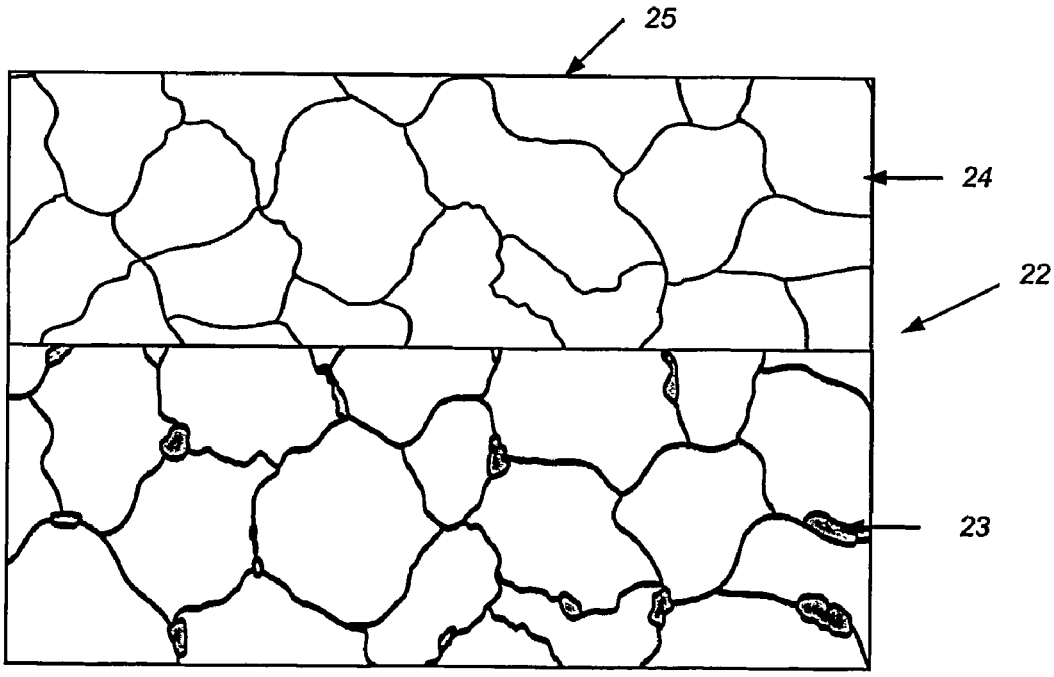
FIG. 6 is a schematic diagram of a microstructure of a sink roll formed from a 316L stainless steel and high nitrogen stainless steel.

FIG. 6 illustrates an alternative arrangement where the component is manufactured from a composite structure. FIG. 6 illustrates a schematic diagram of the microstructure 22 of a portion of the component where an inner layer 23 is formed from a conventional stainless steel such as 316L and an outer layer 24 which incorporates the outer surface 25 is formed from the high nitrogen stainless steel.

The following example illustrates the improved corrosion resistance using the high nitrogen stainless steel.

Example

Immersion tests of samples of a 316LN stainless steel alloy were conducted in a 55% AL—ZN alloy bath. The tests were conducted over a 4 month period and samples were removed from the bath after immersion for 2 weeks, 1, 3 and 4 months.

316LN alloy is a nitrogen containing austenitic stainless steel and its composition is as follows:

| Steel Type | C | Mn | Si | Cr | Ni | P | S | Mo | N |
|---|---|---|---|---|---|---|---|---|---|
| 316LN | 0.03 | 2.0 | 1.0 | 16.0-18.0 | 10.0-14.0 | 0.045 | 0.03 | 2.0-3.0 | 0.10-0.16 |

Figure 7:
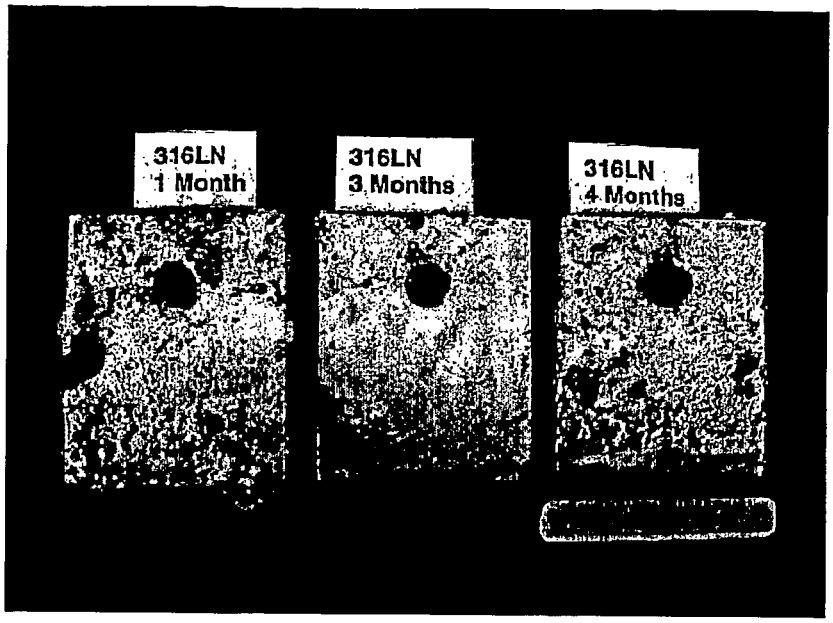
FIG. 7 is a photograph of the surface appearance of immersion samples formed from 316LN stainless steel after 1, 3 and 4 months.

FIG. 7 is a photograph of the surface appearance of the 316LN immersion samples 30, 31 and 32 after 1, 3 and 4 months after continuous immersion in the metal bath. Visual examination showed no evidence of erosion or localised pitting or thinning of the edges of the sample. In addition, the surface of the samples showed no evidence of spiked or horned growth (ie. cone-shaped alloy outbreaks on the surface of the immersed pot gear). Spike growth is related to the presence of .sigma.-phase in the microstructure of the pot gear.

Figure 8:
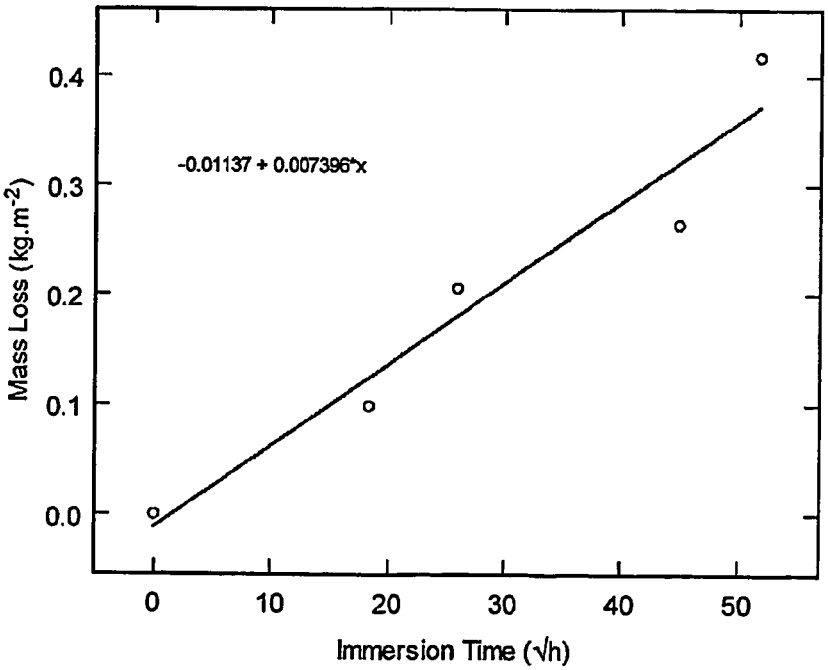
FIG. 8 is a parabolic plot of alloy layer growth for the samples immersed for 2 weeks, 1, 3 and 4 months.

The immersion samples also reacted with the bath metal and formed an alloy layer similar in composition to that found in 316L. FIG. 8 shows the alloy growth as a function of the square root time of immersion. The graph indicates that the alloy growth rate is diffusion controlled.

Accordingly, the use of a high nitrogen stainless steel, where the nitrogen is introduced into the melt (as distinct from a nitriding process) exhibits enhanced performance as compared to conventional 316L stainless steel. Whilst test conducted to date clearly illustrate the enhanced performance in using high nitrogen stainless steel as components in a hot dip apparatus, the mechanism by which those improvements are obtained is not certain. Nevertheless, whilst not binding the invention to theory, the inventors consider that one contributing factor for the enhanced performance is that the nitrogen within the microstructure of the high nitrogen stainless steel is able to move sufficiently freely so as able to move to the surface where it can react with the aluminium to form an outer layer of aluminium nitride. A further mechanism that may contribute to the improved performance is through the nitrogen restricting the growth of the σ-phase precipitates. The underlying cause of for σ-phase precipitation in austenitic stainless steels such as 316L is associated with the presence of a small amount of δ-ferrite phase in the microstructure. The presence of δ-ferrite in 316L promotes the precipitation of σ-phase in the microstructure of 316L after extended time of exposure at operating bath temperature. Nitrogen is an austenite stabiliser and the addition of nitrogen as an alloying addition significantly reduces the level of δ-ferrite in the stainless steel. Furthermore, increasing the nitrogen content of the alloy increases the resistance of the alloy to localised corrosion like pitting or intergranular corrosion.

Whilst the use of a 316LN stainless steel has been used, it is considered that other compositions of commercially available steel may also provide the enhanced performance. The following table sets forth compositions of other commercially available steels containing appreciable amounts of nitrogen distributed substantially uniform throughout their microstructure at levels equal to or more than that of the 316LN, and which are therefore also considered to be of use in the apparatus of the present invention.

| Steel Type | C | Mn | Si | Cr | Ni | P | S | Mo | N |
|---|---|---|---|---|---|---|---|---|---|
| 201 | 0.15 | 5.5-7.5 | 1.0 | 16.0-18.0 | 3.5-5.5 | 0.06 | 0.03 | — | 0.25 |
| 202 | 0.15 | 7.5-10.1 | 1.0 | 17.0-19.0 | 4.0-6.0 | 0.06 | 0.06 | — | 0.25 |
| 205 | 0.12-0.25 | 14.0-15.5 | 1.0 | 16.5-18.0 | 1.0-1.75 | 0.0 | 0.03 | — | 0.10-0.16 |
| 304LN | 0.03 | 2.0 | 1.0 | 18.0-20.0 | 8.0-12.0 | 0.045 | 0.03 | — | 0.10-0.16 |
| 304N | 0.08 | 2.0 | 1.0 | 18.0-20.1 | 8.0-10.5 | 0.045 | 0.03 | — | 0.10-0.16 |
| 316LN | 0.03 | 2.0 | 1.0 | 16.0-18.0 | 10.0-14.0 | 0.045 | 0.03 | 2.0-3.0 | 0.10-0.16 |
| 316N | 0.08 | 2.0 | 1.0 | 16.0-18.0 | 10.0-14.0 | 0.045 | 0.03 | 2.0-3.0 | 0.10-0.16 |

Accordingly, the present invention provides components for a hot dip coating apparatus which have improved corrosion resistance through the use of high nitrogen stainless steel. Whilst an advantage of the present invention is that it can obviate the need for separate pre-treatment, such as a separate nitriding process, it is to be appreciated that if necessary, the present invention in one form may also be used in conjunction with such processes. For example, such an arrangement may be used to provide a nitrided layer adjacent the outer surface of the component so as to ensure that an outer layer of aluminium nitride forms on immersion on the component into the molten bath. In that application, the aluminium nitride layer would allow for easier removal of the build up of intermetallic compounds on the surface. The nitrogen within the microstructure of the stainless steel could inhibit the growth of the σ-phase precipitates and also provide a feed of nitrogen to the outer layer so that the aluminium nitride could be regenerated if it is broken.

A further advantage of the present invention, is that considerably more dressing of the roll may be effected than in the case with a nitrided roll made of conventional steel devoid of nitrogen in its untreated composition. This is because relatively few dressings of the prior art roll result in the complete removal of its nitrided layer, requiring restoration of that layer via further nitriding operations.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

Variations and/or modifications may be made to the parts previously described without departing from the spirit or ambient of the present invention.

The invention claimed is:

1. A hot dip coating apparatus for coating a steel strip wherein the strip is immersed in a bath of coating alloy containing aluminum, the apparatus comprising:

a bath of molten coating alloy containing Al—Zn alloy, at least one component immersed in the bath of coating alloy containing Al—Zn alloy, the at least one component having a surface that comes into contact with the bath when in use, wherein the at least one component is made from at least one of 304LN and 316LN stainless steel containing greater than 0.10 wt % amount of nitrogen distributed substantially uniformly throughout its microstructure as an austenite stabliser, and up to 0.03 wt % carbon.

2. The hot dip coating apparatus according to claim 1, wherein the at least one component is a sink roll under which the steel strip is passed.

3. A hot dip coating apparatus for coating a steel strip wherein the strip is immersed in a bath of coating alloy containing aluminum, the apparatus comprising:

a bath of molten coating alloy containing Al—Zn alloy, at least one component immersed in the bath of coating alloy containing Al—Zn alloy, the at least one component having a surface that comes into contact with the bath when in use, wherein the at least one component includes at least one layer made from at least one of 304LN and 316LN stainless steel containing greater than 0.10 wt % amount of nitrogen distributed uniformly through its microstructure as an austenite stabliser, and up to 0.03 wt % carbon.

4. The hot dip coating apparatus according to claim 3, wherein the at least one component includes a further layer, and wherein the stainless steel layer containing the nitrogen and carbon is disposed between the surface and the further layer.

5. The hot dip coating apparatus according to claim 4, wherein the further layer is formed from stainless steel.

6. The hot dip coating apparatus according to claim 3, wherein the at least one component is a sink roll under which the metal strip is passed.

7. The hot dip coating apparatus according to claim 6, wherein the at least one component includes a further layer, and wherein the stainless steel layer containing the nitrogen is disposed between the surface and the further layer.

8. A method of coating a steel strip wherein the strip is immersed in a bath of coating alloy containing Al—Zn alloy, the method comprising the steps of:

providing a bath of molten coating alloy containing Al—Zn alloy;

providing a component made from at least one of 304LN and 316LN stainless steel containing greater than 0.10 wt % amount of nitrogen distributed substantially uniformly through its microstructure as an austenite stabliser, and up to 0.03 wt % carbon;

immersing said component within the molten coating alloy; and passing the steel strip about said component immersed in the bath.

* * * * *